United States Patent [19]

Campbell et al.

[11] 4,149,170

[45] Apr. 10, 1979

[54] MULTIPORT CABLE CHOKE

[75] Inventors: Donn V. Campbell, Eatontown, N.J.; James J. Arnold, deceased, late of Farmingdale, N.J., by Susan Arnold, executrix

[73] Assignee: The United States of America as represented by the Secretary of the Army, Washington, D.C.

[21] Appl. No.: 900,831

[22] Filed: Apr. 28, 1978

Related U.S. Application Data

[63] Continuation-in-part of Ser. No. 748,990, Dec. 9, 1976, abandoned, which is a continuation of Ser. No. 614,283, Sep. 17, 1975, abandoned.

[51] Int. Cl.[2] ..... H01Q 1/52

[52] U.S. Cl. ..... 343/885; 333/12; 333/206

[58] Field of Search ..... 333/12, 73 R; 343/792, 343/878, 885, 909

[56] References Cited

U.S. PATENT DOCUMENTS 3,534,371 10/1970 Seavey ..... 343/792

*Primary Examiner*—Eli Lieberman

*Attorney, Agent, or Firm*—Nathan Edelberg; Sheldon Kanars; Daniel D. Sharp

[57] ABSTRACT

A unitary broadband high impedance isolation section for a plurality of closely spaced antennas as well as other electrical apparatus wherein the respective separate coaxial cables feeding the antennas and the shielded multi conductor cable for the other electrical apparatus are wound in the same direction on a common core and have the same number of turns, with the shields or outer conductors of all the cables being respectively connected together at the beginning and the end of the windings. The multiport cable choke thus configured can be provided with respective connectors at each end of the choke for facilitating ease of installation into the electrical system, that is, a single multiport cable choke can be inserted in the feed lines of multiple antennas and other electrical equipment simply by means of making suitable interconnections by way of the connectors on both sides of the multiport cable choke assembly. Further, the multiport cable choke can be contained in a suitable dielectric housing enveloping the common core and the cable windings and the connectors can be mounted in this housing.

16 Claims, 15 Drawing Figures

FIG. 1 (Prior Art)
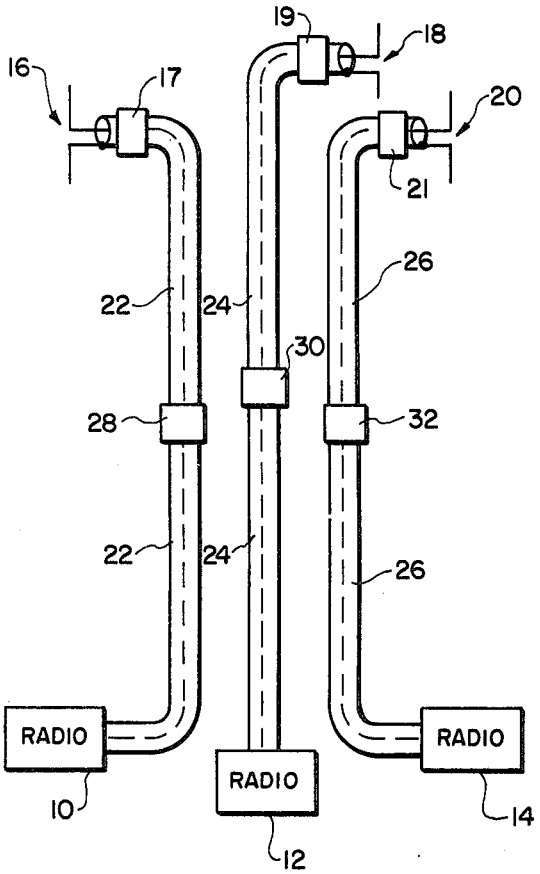
FIG. 4
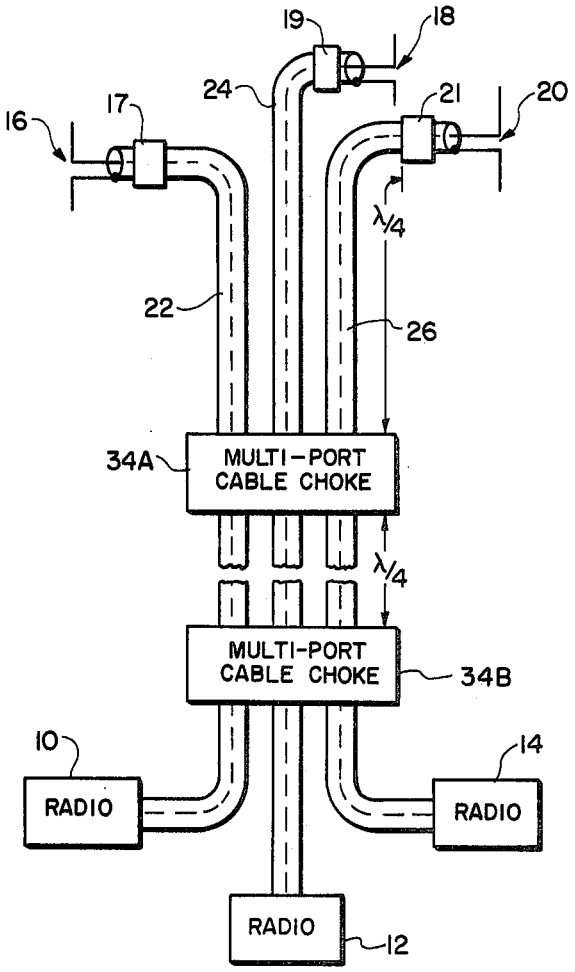
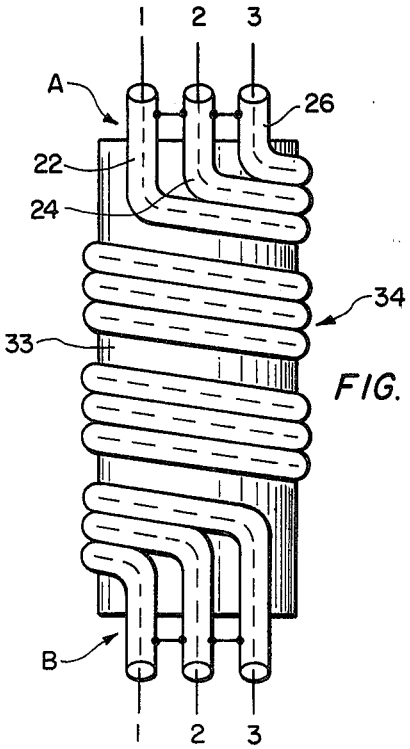
FIG. 5
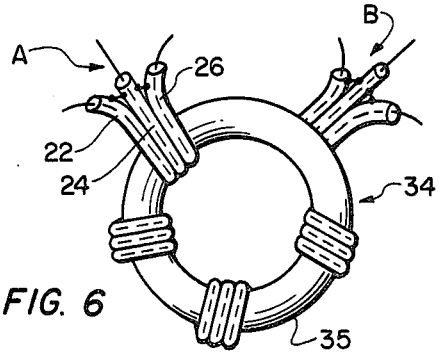
FIG. 6

MULTIPORT CABLE CHOKE

The invention described herein may be manufactured and used by or for the Government for governmental purposes without the payment of any royalties thereon or therefor.

This application is a continuation-in-part of a copending application, Ser. No. 748,990, filed Dec. 9, 1976, now abandoned which, in turn, is a continuation application of an original application, Ser. No. 614,283, filed Sept. 17, 1975, now abandoned.

BACKGROUND OF THE INVENTION

The present invention relates generally to isolation apparatus for multiple antenna installations and more particularly for certain installations such as portable aircraft control facilities having many closely spaced antennas and other auxiliary apparatus such as a wind sensor together with a plurality of respective radio transceivers. This equipment is included in a self-contained unit which as a consequence of relatively close spacing normally has undesired interaction between the antennas, the vertically disposed feed lines, and the wind sensor control cable.

It is well-known that the electrical characteristics of an antenna can be adversely affected when situated in the vicinity of other antennas, metal masts, metal surfaces, electrical wiring or transmission lines. For example, the antenna impedance and radiation characteristic may be substantially changed due to the parasitic excitation and reradiation by and from the other conductors.

In certain military installations, such as in aircraft control towers where many closely spaced antennas for different frequencies are employed, acceptable antenna performance is difficult to obtain. The various antennas interact with one another, resulting in modified impedances and radiation characteristics.

When attempting to analyze the radiation characteristics of a complicated system such as a portable aircraft traffic control facility for military use, and more particularly a facility such as the AN/TSQ-97, not only the antennas, but the entire structure consisting of antennas, cables, wind sensor, console ground and metal masts, have to be regarded as a complex system for radiating and absorbing electromagnetic waves. Accordingly, it is very difficult if not impossible to predict theoretically the radiation characteristics of such a complex structure. It is practical, however, to measure the antenna patterns in the horizontal and vertical planes, but the experimental determination of radiating characteristics is a time consuming procedure when the operating bandwidth is great and therefore such a determination may have to be based upon measurements made at only a few selected frequencies.

One approach to the problem of improving the radiation properties of a multi-antenna system is to locate all of the antennas on a common vertical axis. Such an arrangement provides a substantially omnidirectional pattern in the horizontal plane. Radiation in the vertical plane, however, depends upon current distribution, antenna height above ground and operating frequency. Over all, such an antenna system provides relatively better performance in comparison to any radiating system having antennas mounted in a broadside relationship.

Where, however, a broadside array is desirable, notwithstanding the advantages gained by a vertical in-line array, it is possible to reduce the strength of the induced feed line currents by careful arrangement of radiators and avoiding resonant lengths of feed lines; however, in a case of systems operating over a broad frequency range, e.g., over two octaves for example, it is very difficult to pick optimum lengths of cables, etc.

One means which is helpful in optimizing broadband radiating systems is to insert separate high impedance broadband cable chokes in series with the antenna feed lines. When connected in series with feed lines, the high impedance property of the cable choke can tend to suppress feed line current flowing on the outside of the feed line induced by the impressed electrical field. Illustrative examples of such apparatus is taught for example, in U.S. Pat. No. 3,879,735 of Donn V. Campbell and James J. Arnold, entitled "Broadband Antenna System With Isolated Independent Radiators;" and U.S. Pat. No. 3,961,331 of Donn V. Campbell, entitled "Lossy Cable Choke Broadband Isolation Means for Independent Antennas," both assigned to the assignee of the present invention. The cable chokes illustrated therein consist of a high inductance made by winding a plurality of coaxial cables in the shape of a helix and with several separate cable chokes being provided in those cases in which different frequency ranges are involved. For example, one choke may impede feed line current at frequencies between 30 and 80 MHz while another choke may be designed for the frequency range of 200–400 MHz. At VHF frequencies, the choke would normally be wound on a magnetic core such as ferrite in order to maximize the inductance of the cable choke while at UHF frequencies, the magnetic core is usually deleted.

SUMMARY

Instead of employing a separate choke for each feed line, it has been found practical to utilize one or more multiport cable chokes in the feed line in accordance with the teaching of the subject invention. Briefly, the subject invention is directed to the improvement comprising the winding of a plurality of coaxial cables and any other shielded multiconductor cable(s) respectively adapted for connection to a plurality of antennas and auxiliary apparatus, in the same direction on a common core with the same number of turns and having the shields or outer conductors of all the cables commonly connected together at each end of the winding adjacent to the core. Additionally, the choke including the core and windings may be included in a non-magnetic, nonconducting housing having end walls including connector means respectively for each of the coaxial cables and shielded multi-conductor cables(s). These chokes preferably are inserted a quarter wave length from the antennas for maximum effect. When a broad band of frequencies, or a plurality of separate frequencies, is involved, one can establish the quarter wave spacing on the basis of the center of the band or the arithmetic mean frequency, as the case may be. The chokes are each tuned to the geometrical mean frequency when the frequency bandwidth is of the order of an octave or less. For example, if the bandwidth extends between frequencies $f_1$ or $f_2$, or if the two separate frequencies $f_1$ and $f_2$ are separated by not more than an octave, the chokes would be tuned to approximately $f_0=\sqrt{f_1 f_2}$. If two separate widely spaced frequencies are involved, one multiport choke could be tuned to frequency $f_1$ and the other multiport choke tuned to frequency $f_2$.

BRIEF DESCRIPTION OF THE DRAWINGS

FIG. 1 is illustrative of prior art practice whereby separate cable chokes are utilized for each antenna of an array;

FIG. 4 is a schematic diagram broadly illustrative of the concept of the subject invention;

FIG. 5 is a plan view of one embodiment of the subject invention;

FIG. 6 is a plan view of another embodiment of the subject invention equivalent to the one shown in FIG. 5;

DESCRIPTION OF THE PREFERRED EMBODIMENTS

Figure 3:
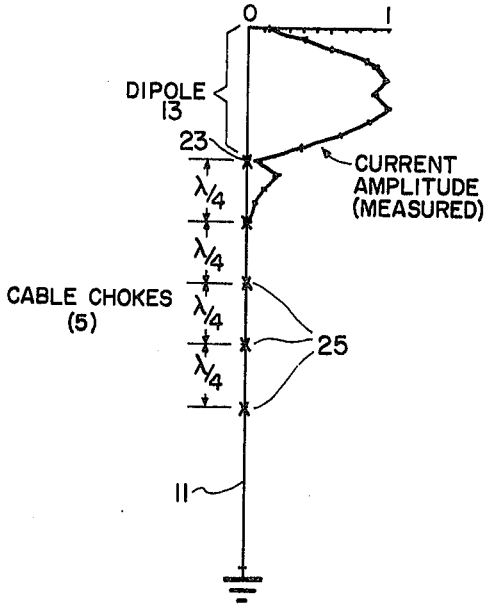
FIG. 3 is a diagram illustrating the measured current amplitude along the same structure as shown in FIG. 2 when cable chokes are positioned at quarter wave length intervals.

An antenna is a conductor so constructed as to either radiate electromagnetic energy, to collect electromagnetic energy, or both. A transmitting antenna converts electrical energy into electromagnetic waves called ratio waves which radiate away from the antenna at speeds near the velocity of light. A receiving antenna converts electromagnetic waves which it intercepts into electrical energy and applies this energy to electronic circuits for interpretation. Some antennas are adapted to serve both functions and accordingly the electrical and physical features are determined by the use to which they are put. Such features will vary with operating frequency, power handling capability, plane of polarization, and desired radiation field pattern. The physical size of an antenna is determined by its operating frequency and power handling capability while its shape and height are determined by the desired radiation field pattern. Such apparatus is well known to those skilled in the art and is well documented in all the literature dealing with fundamentals of radio transmission.

The subject invention is directed to an improved means for reducing the interaction of closely spaced antennas, auxiliary apparatus, and the respective feed lines therefor.

Referring now to the drawings, reference is first made to FIG. 1 which is illustrative of prior art practice wherein a plurality of radio apparatus 10, 12, and 14 are coupled to respective dipole antennas 16, 18 and 20, mounted in a broadside array by means of the feed lines 22, 24 and 26. As shown in FIG. 1 single port chokes 17, 19 and 21, constructed in the manner shown in FIG. 6 of the earlier-mentioned U.S. Pat. No. 3,879,735, preferably should be located as close as possible to the point of connection of the feed lines to the corresponding antenna radiating elements (for example, the dipole arms in a center-fed dipole antenna) to create a high impedance point at said point of connection and establish the correct electrical length of the radiating elements. The single port choke could be replaced by a quarter wave coaxial sleeve choke with the sleeve surrounding the feed line and the end of the sleeve remote from the antenna connected to the shield of the feed line. In addition, each of the feed lines 22, 24 and 26 includes a separate series connected cable choke 28, 30, 32. The feed lines 22, 24 and 26 are comprised of coaxial transmission lines and the cable chokes 28, 30 and 32 are formed from a portion of the coaxial cable wound in the shape of a helix as shown for example in the above referenced U.S. Pat. No. 3,879,735, and are configured for the operating frequencies of the respective radio apparatus 10, 12 and 14 with which they are utilized.

Figure 2:
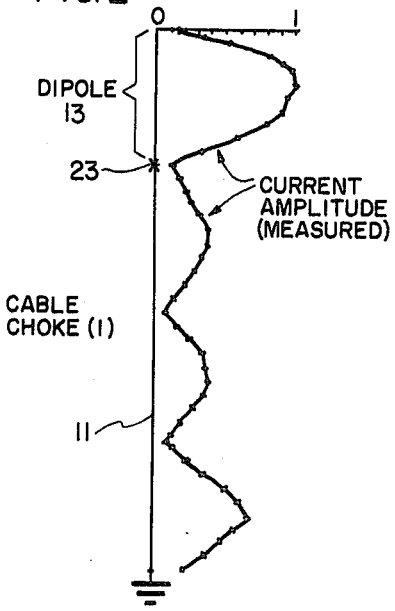
FIG. 2 is a diagram illustrating relative amplitude of surface current as measured along the length of a typical mast or line connected to a half wave dipole antenna.

FIG. 2 illustrates the undesirable build up of surface currents along a typical single coaxial antenna feed line 11 connected between a dipole antenna 13 and ground and including a single cable choke 23 indicated by a cross in FIG. 2 (corresponding to chokes 17, 19 and 21 of FIG. 1) located at one end of the dipole to define the half wave length of the dipole. In addition to the dipole radiating current, spurious current peaks occur at half wave length intervals along the feed line 11.

By positioning a plurality of single port cable chokes 25 along feed line 11 at quarter wave intervals, starting at a quarter wave length from the antenna choke 23, as indicated in FIG. 3 the measured antenna feed line current is substantially eliminated, except for a negligible current peak just below the dipole. It has been found that, at a distance of about one wave length from the dipole, further chokes usually are not required. In some instances, one single port choke 23 can provide adequate reduction of feed line current. The larger the inductance of the choke, the greater is the reduction of shield currents along the feed line.

Referring now to FIG. 4, there is disclosed in block diagrammatic form the basic concept of the subject invention. Single port chokes 17, 19 and 21 are connected adjacent the respective antennas, 16, 18 and 20, as shown in FIG. 1. The plurality of radio apparatus 10, 12 and 14 of FIG. 4 are coupled to their respective antennas 16, 18 and 20 through unitary multiport cable chokes 34A and 34B, two embodiments of which are shown in FIGS. 5 and 6. FIG. 5 is illustrative of one embodiment of the subject invention wherein the three feed lines 22, 24 and 26 are wound side by side in the same direction with the same number of turns on a common core 33 comprised preferably of a cylinder of ferrous material such as ferrite, but, when desired, can be made from non-ferrous non-conducting material. Each of the multiport cable chokes 34 are inserted a quarter wave length from the corresponding single port chokes 17, 19 and 21 at the respective antennas 16, 18 and 20, as shown in FIG. 4 and the interval between chokes 34A and 34B is a quarter wave length. In some cases, one multiport choke along the feed lines may not suffice. Usually, one can reduce spurious feed line currents to a negligible amount after proceeding about one wave length along the feed line; in other words, no more than four multiport chokes 34 are normally required.

The shields or outer conductors of the coaxial cables 22, 24 and 26 are electrically connected together at both ends of the respective windings such as at points A and B as shown in FIG. 5. When so connected, the radio frequency potential of all three windings is the same at end A and likewise the potential of the three windings is the same at point B, although the potential at point A may differ from the potential at point B. The configuration shown in FIG. 6 is similar in all respects except that a toroidal core 35 is depicted; as in FIG. 5, all coaxial cable windings are wound in the same direction with the same number of turns and the shields are interconnected at the ends of the windings.

Figure 7:
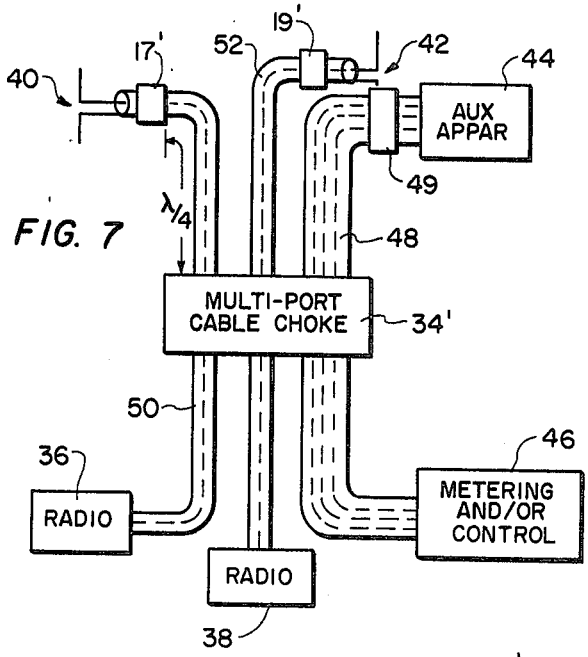
FIG. 7 is an electrical schematic view further illustrative of the concept of the subject invention.

Referring now to the configuration shown in FIG. 7, there is contemplated in addition to a pair of radio apparatus 36 and 38 coupled to respective antennas 40 and 42, the use of auxiliary apparatus 44 which may be, for example, a wind sensor or other devices associated with a portable aircraft traffic control facility coupled to respective control and/or metering apparatus 46 through a shielded multi-conductor cable 48.

Owing to the proximity of the feed line 48 for the auxiliary apparatus 44 of FIG. 7 to the feed lines 50 and 52 for antennas 40 and 42, the possibility exists that, in the absence of choke means, in the feed lines 50 and 52, spurious currents could appear on feed lines 50 and 52 and induce spurious shield currents in feed line 48. Moreover, spurious currents could also be induced in all three feed lines 48, 50, and 52 of FIG. 7 owing to the presence of additional radiation sources in the vicinity. These undesirable shield currents in feed line 48 could then be coupled into auxiliary apparatus 44 or device 46, thereby adversely influencing the operation of devices 44 and 46. Similarly, when no choke means is used in the feed lines, it is possible that spurious currents appearing along feed line 48 could be induced into antenna feed lines 50 and 52.

As in the case of FIG. 4, and for reasons pointed out in the description of FIG. 4, single port chokes 17' and 19' are inserted adjacent the antennas 40 and 42; in addition, a multiport choke 49 is inserted at the point of connection of the feed line 48 to the auxiliary apparatus. The multiport cable choke 34' of FIG. 7 (in the case illustrated, a three-port choke) is positioned a quarter wave length from the chokes 17', 19', and 49'. The feed line 48 is illustrated in FIG. 7 as including three separate conductors; however, the number of such conductors is not restricted to three.

Although only one multiport cable choke 34' is shown in the feed lines of FIG. 7, two or more such multiport cable chokes can be used, as indicated in FIG. 4, and such cable chokes would be spaced apart from one another by a quarter wave length, and the multiport cable choke nearest cable chokes 17', 19', and 49' would be spaced one quarter wave length from each of the latter three chokes.

Figure 8:
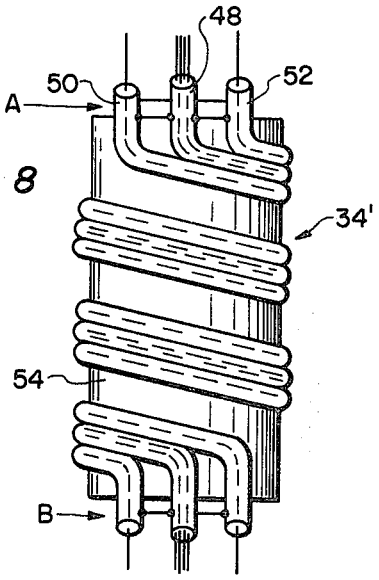
FIG. 8 is a plan view of yet another embodiment of the subject invention.
Figure 9:
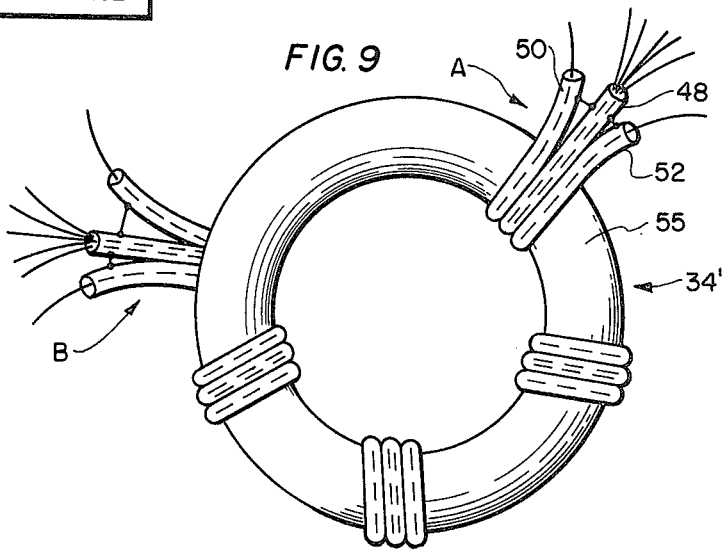
FIG. 9 is a plan view of an embodiment of the subject invention equivalent to the embodiment shown in FIG. 8.

Schematically, the multiport cable choke 34' is shown in two forms in FIGS. 8 and 9 wherein the two coaxial feed lines 50 and 52 are wound together with the shielded multiconductor cable 48 on a common core composed of ferrous or non-ferrous, non-conducting material. In FIG. 8 there is disclosed a cylindrical core 54 whereas in FIG. 9 a toroidal core 55 is shown. The cables 48, 50 and 52 are wound in the same direction about the core 55 and are located adjacent one another; furthermore, each of the cables has the same number of turns on the core. It should also be pointed out that the cables 48, 50 and 52 are covered with suitable insulation so as to prevent short circuits between adjacent turns. As in the case for the other embodiments shown in FIGS. 5 and 6, at the beginning and end of the winding, i.e., at points A and B, the shields or outer conductors are electrically connected together for the purposes set forth above. Accordingly, since the three cables 48, 50 and 52 are wound in the same direction on a common core 54 with the same number of turns, it follows that the impedance characteristic of the entire assembly will be unitary.

The single multiport cable choke concept is a distinct improvement over the prior art due to the fact that the following disadvantages accrue with the use of separate cable chokes as shown in FIG. 1. First, the capacitive coupling between adjacent shields, i.e., outer conductors, and the fact that the RF potential of the shields at the points where they are connected to the separate chokes will in general cause external feed line currents to be induced on the shield which in turn will interfere with the normal operation of the separate antennas. Secondly, the fact that the chokes are wound on separate cores the effective resonant frequency of the respective chokes will tend to be different and will be a function of the spacing and placement of the chokes with respect to each other, whereas the multiport cable choke of the subject invention will have a well established unitary resonant frequency.

Figure 10:
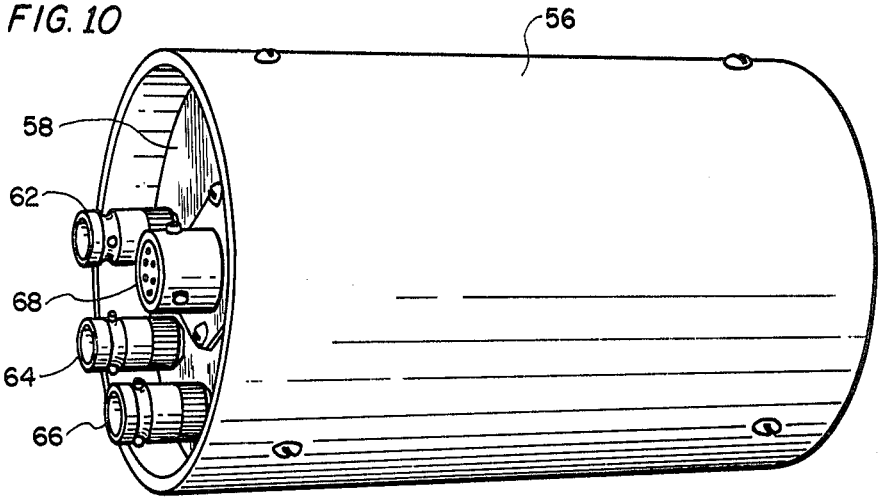
FIG. 10 is a perspective view of the housing for the subject invention.
Figure 11:
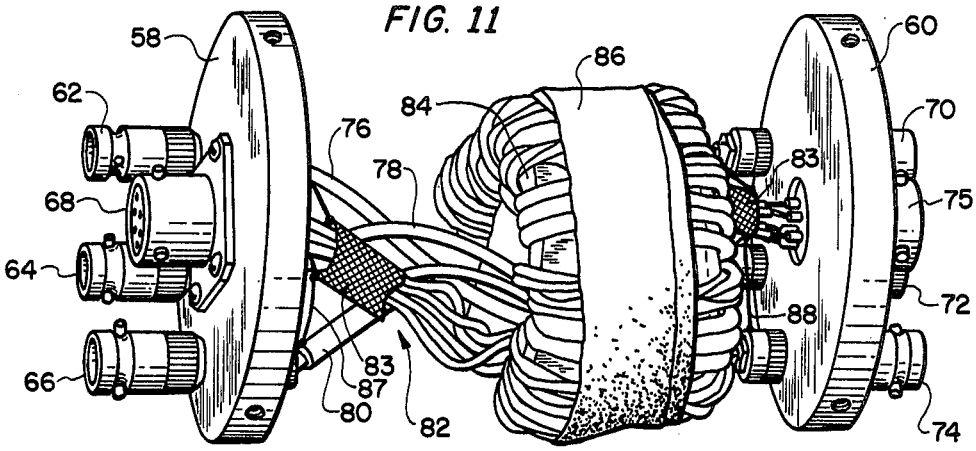
FIG. 11 is a perspective view of an embodiment of the subject invention which is adapted to be located in the housing shown in FIG. 10.
Figure 12:
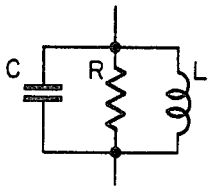
FIG. 12 is an electrical equivalent circuit diagram of the subject invention.
Figure 13:
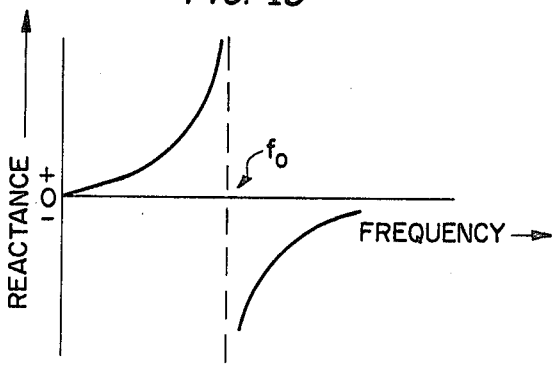
FIG. 13 is a diagram illustrative of the reactance vs. frequency characteristic of the subject invention.

Referring now to FIGS. 10 and 11, there is disclosed a physical embodiment of the present invention. Reference numeral 56 designates a generally cylindrical dielectric housing having a pair of end walls 58 and 60. A first plurality of coaxial connectors 62, 64 and 66 and a multipin connector 68 are mounted on the end wall 58 while a like number of coaxial connectors 70, 72 and 74 as well as a corresponding multipin connector 75 are mounted on the other end wall 60. Three coaxial cables 76, 78 and 80 as well as a set of electrical conductors 82 inside of a braided shield 83 (shown partially cut-away) are wound adjacent one another on a toroidal ferrite core 84 and being held in position on the core by means of a piece of electrical tape 86. Thus, for example, the coaxial cable 76 terminates in opposing coaxial connectors 62 and 74, the coaxial cable 78 in opposing coaxial connectors 64 and 70 and coaxial cable 80 in coaxial connectors 66 and 72. The set of electrical conductors 82 accordingly terminates in the pair of multipin connectors 68 and 75. The fact that all of the coaxial cables and electrical conductors have the same number of turns and the coaxial cables and the shielded cable have their outer conductors commonly connected together as by connections 88 and 87, adjacent their respective connectors exhibits an equivalent circuit as shown in FIG. 12 and having a reactance vs. frequency characteristic such as shown in FIG. 13, wherein a single resonant frequency $f_0$ is established.

The number of turns used in a given choke depends on such factors as the core permeability, operating frequency and required bandwidth. In general, bandwidth is inversely proportional to the self-capacitance C (FIG. 12) of the winding. Greatest bandwidth is obtained by minimizing the self-capacitance.

Another factor to be considered in the design of a cable choke according to the subject invention is the power loss in the magnetic core and surrounding dielectric material. When connected in series with the transmission line, it is possible that high RF voltages can develop across the choke and considerable power could be dissipated in the choke.

For operation in the frequency range of 30–70 MHz, the parallel resistance R of the multiport cable choke is in the order of 10,000 ohms; however, as long as the radio frequency voltage across the choke is less than 100 volts, rms power loss is less than 1 watt. The reactance of the multiport cable choke, as is well known, is a function of frequency and varies in the same way as the reactance of a parallel tank circuit being positive for frequencies below resonance and negative for frequencies above resonance.

Bandwidth is defined somewhat arbitrarily by the frequency range within which the cable choke's reactance exceeds a certain minimum value. For example, suppose that the minimum acceptable choke reactance is 1,000 ohms in a particular application. With such a specification, the VHF multiport cable choke according to the subject invention has a broadband width extending from approximately 37 MHz to above 70 MHz.

Figure 14:
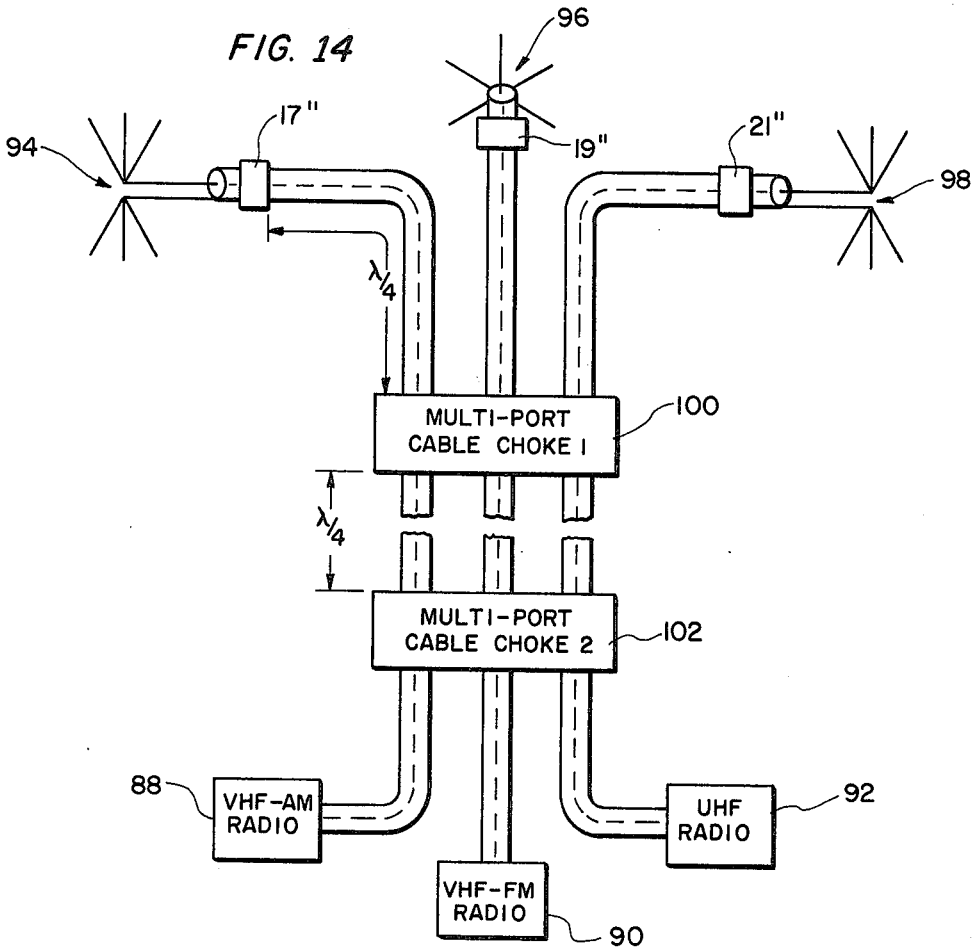
FIG. 14 is a diagram illustrative of a radio system for a plurality of radio apparatus operating on different frequency bands and employing more than one multiport cable choke according to the subject invention.
Figure 15:
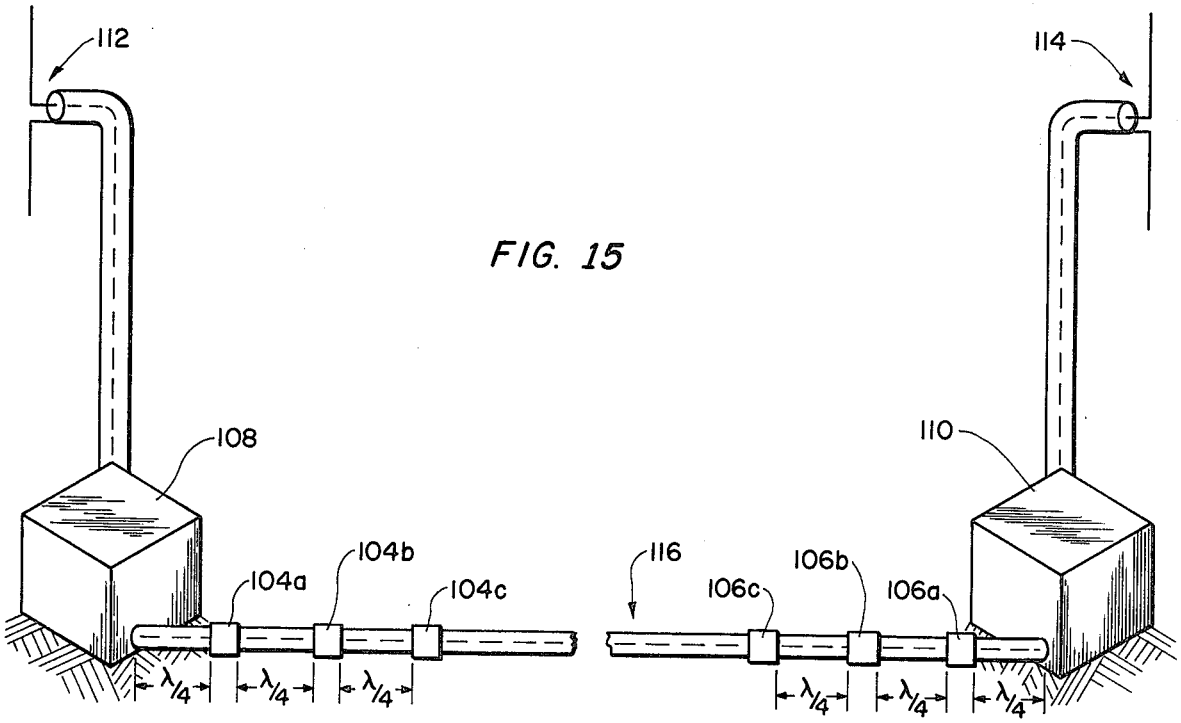
FIG. 15 is a diagram illustrative of a retransmission station employing the subject invention for improving isolation between receiving and sending radio apparatus.

FIGS. 14 and 15 are included to indicate the use of multiport cable choke tuned to different resonant frequencies to reduce antenna interaction and feed line radiation where different frequency bands are employed by separate radio apparatus. More particularly, a VHF-AM radio 88, a VHF-FM radio 90, and a UHF-radio 92 are coupled to respective antennas 94, 96 and 98 through two multiport cable chokes 100 and 102 and which would be configured, for example, in the manner shown in FIGS. 5 and 6. As indicated in connection with the embodiments of FIGS. 4 and 7, high impedance chokes 17'', 19'', and 21'' are inserted adjacent antennas 94, 96, and 98, respectively.

Referring now to FIG. 15, there is disclosed another application for the subject invention wherein one or more multiport cable chokes **104*a* to 104*c* and 106*a* to 106*c* spaced at quarter wave intervals are used to improve electrical isolation between radio apparatus 108 and 110 included in a retransmission station which for example receives signals on antenna 112 and re-transmits radio signals from antenna 114. Reference numeral 116 denotes a harness including various audio/control wiring/radio frequency cables interconnecting the radio apparatus 108 and 110**.

Thus what has been shown and described is a multiport cable choke which by virtue of its high impedance property minimizes feed line radiation while at the same time providing connections as may be required for remote control power supply or sensing apparatus and radio frequency signal transmission while at the same time reducing weight and complexity of the radio system. Additionally, when desired, such apparatus is adapted to improve electrical isolation between radio apparatus irrespective of their utilization in connection with antenna feed lines, and so forth.

What is claimed is:

1. In combination, a plurality of electromagnetic wave transmission lines each interconnecting one group of electrical apparatus and another group of electrical apparatus, and at least one multiport choke means for preventing buildup of undesired radio frequency currents along the external portions of said wave transmission lines, said multiport choke means comprising a single core having a plurality of windings of the same number of turns adjacently wound on said core in the same direction, said windings each comprising an electrical conductor means with a shield member, each of said windings being continuous with a corresponding one of said wave transmission lines, said multiport choke means further including a direct electrical connection adjacent said core between said choke shield members at each end of said choke windings.

2. The combination of claim 1 wherein said single core is a toroidal core.

3. The combination of claim 1 wherein said single core is of generally cylindrical shape.

4. The combination of claim 1 including connector means for said wave transmission line and connector means at both ends of the windings of said multiport choke means for interconnecting corresponding wave transmission means and shielded electrical conductor means.

5. The combination of claim 4 wherein said multiport choke means is contained within a dielectric housing having said conductor means mounted thereto.

6. The combination of claim 1 wherein each of one of said groups of electrical apparatus comprises antenna means.

7. The combination of claim 1 wherein said one multiport choke means is positioned substantially a quarter wave length distant from said one group of electrical apparatus.

8. The combination of claim 7 further including a high impedance choke positioned in each of said wave transmission lines at the point of connection of said corresponding transmission line to the respective electrical apparatus and disposed a quarter wave length from said one multiport choke means.

9. The combination of claim 1 wherein each of said one group of electrical apparatus comprises a receiving antenna and a receiver and each of said second group of apparatus comprises a transmitter and a transmitting antenna.

10. The combination of claim 1 wherein each of said one group of electrical apparatus is an antenna and each of the other of said group of electrical apparatus is a radio receiver.

11. The combination of claim 1 comprising a plurality of said multiport choke means spaced at quarter wave length intervals along said wave transmission lines.

12. The combination of claim 11 further including a high impedance choke positioned in each of said wave transmission lines at the point of intersection of said corresponding transmission line to the respective electrical apparatus and disposed a quarter wave length from the multiport choke means nearest said electrical apparatus.

13. The combination of claim 12 wherein one of said transmission lines includes a plurality of electrical conductors within the shield member and the high impedance choke associated therewith is a multiport choke.

14. The combination of claim 11 wherein said transmission lines propagate wave energy at more than one frequency and wherein the spacing of said multiport choke means is based on the arithmetic mean of the frequencies involved.

15. The combination of claim 1 wherein said core is made of ferrous material.

16. The combination of claim 1 wherein said core is made of non-ferrous material.

* * * * *